US005161340A

United States Patent [19]

Wetton

[11] Patent Number: 5,161,340

[45] Date of Patent: Nov. 10, 1992

[54] PRECAST CONCRETE STRUCTURES

[75] Inventor: Vincent Wetton, Atherstone, England

[73] Assignee: PCE Group Holdings Limited, a British Company, Atherstone, England

[21] Appl. No.: 391,108

[22] Filed: Aug. 8, 1989

[30] Foreign Application Priority Data

Aug. 9, 1988 [GB] United Kingdom ..... 8818906

[51] Int. Cl.[5] ..... E04B 1/00

[52] U.S. Cl. ..... 52/252; 52/236.7; 52/79.11

[58] Field of Search ..... 52/236.7, 236.8, 236.9, 52/79.11, 79.12, 79.13, 79.14, 582, 252, 723

[56] References Cited

U.S. PATENT DOCUMENTS

| | | | |
|---|---|---|---|
| 1,233,080 | 7/1917 | McClintock | 52/252 X |
| 1,380,324 | 5/1921 | Piggins | 52/236.7 X |
| 1,516,074 | 11/1924 | Borg | 52/236.9 |
| 2,037,482 | 4/1936 | Oliver | 52/723 X |
| 2,211,667 | 8/1940 | Moesly | 52/723 X |
| 2,618,146 | 11/1952 | Ciarlini | 52/252 |
| 2,645,115 | 7/1953 | Abeles | 52/582 X |
| 2,769,332 | 11/1956 | Brown | 52/582 X |
| 3,074,209 | 1/1963 | Henderson | 52/252 X |
| 3,465,484 | 9/1969 | Zaldastani | 52/723 X |
| 3,530,626 | 9/1970 | Mezes | 52/236.7 X |
| 3,611,659 | 10/1971 | Greenhalgh | 52/79.12 |
| 3,613,325 | 10/1971 | Yee | 52/236.8 |
| 3,722,159 | 3/1973 | Kessler | 52/252 |
| 3,788,023 | 1/1974 | Macchi . | |
| 3,892,096 | 7/1975 | Macchi . | |
| 4,081,935 | 4/1978 | Wise | 52/252 X |
| 4,095,389 | 6/1978 | Outram | 52/583 |
| 4,363,200 | 12/1982 | Goldenberg | 52/252 X |

FOREIGN PATENT DOCUMENTS

| | | | |
|---|---|---|---|
| 878230 | 8/1971 | Canada | 52/236 |
| 2318283 | 1/1977 | France | 52/236.8 |
| 1401209 | 7/1975 | United Kingdom . | |

*Primary Examiner*—David A. Scherbel
*Assistant Examiner*—Robert Canfield
*Attorney, Agent, or Firm*—Needle & Rosenberg

[57] ABSTRACT

A precast concrete structure has a joint (Js) connecting together a span of two or more beams (Bx, By) supported on columns (c) in which the joint is disposed substantially at the point of contraflexure of the beams away from the support columns and includes two mating inclined faces one inclined face being formed at the end of each of the beam, the beams being connected without pretensioning across the joint.

7 Claims, 3 Drawing Sheets

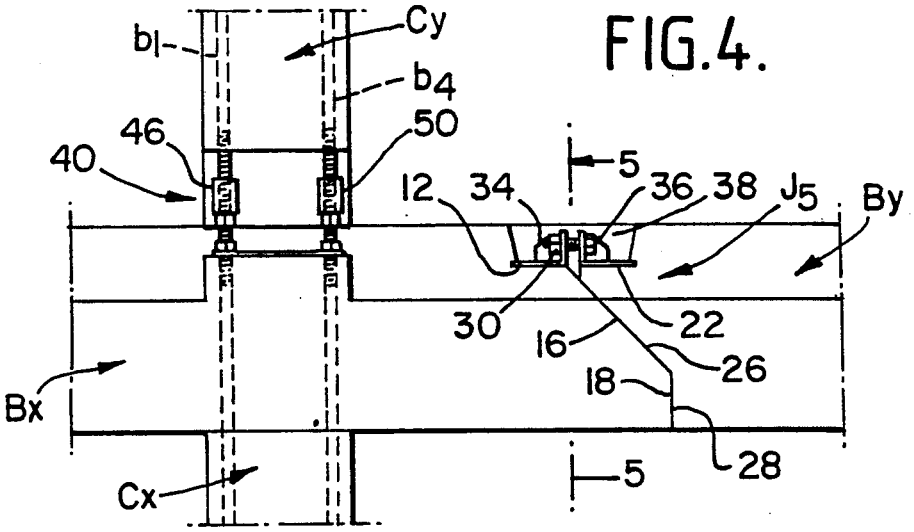
FIG.4.
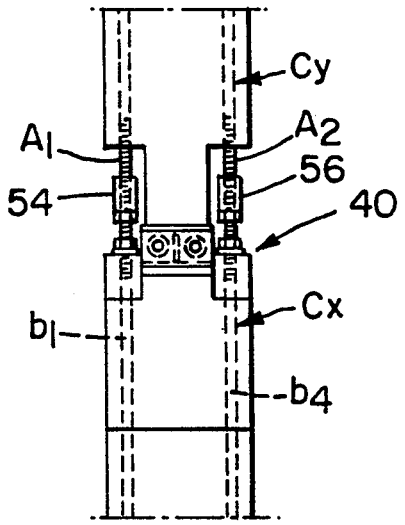
FIG.5.
FIG.6.
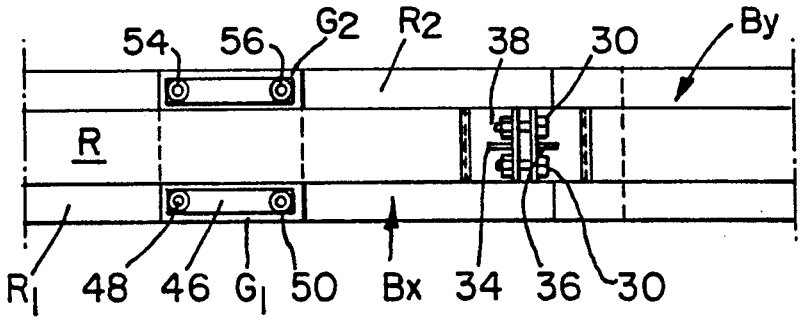

PRECAST CONCRETE STRUCTURES

This invention relates to an improvement in precast concrete structures, to a precast concrete beam for use in such structures and to a method of erecting such structures. The invention in particular is concerned with multi-tier precast concrete structures.

British Patent No. 1,401,209 discloses a beam structure for use in bridges and viaducts i.e. single tier constructions in which mating beams are joined end to end such that the joints between the beams are disposed at a location which is displaced from the upright columns upon which the beams are supported. The joints are formed so that the horizontal and vertical bearing surfaces are brought together by pre-tensioning cables running through the joint from beam to beam.

In the present invention however the joints between adjacent beam ends are disposed at the point of contraflexure of the beam span and the joint comprises mating inclined faces so that positive and negative bending moments of the span are in opposition where they pass through the inclined faces so that little loading is transmitted through the joint. Moreover, the beams are not connected together by pre-tensioning since the form of joint according to the invention renders such form of connection wholly unnecessary. The columns are not made continuous so that a length of the beam intermediate its ends can be seated on and secured to the head of a lower column section and an upper column section then secured above the beam to continue a next tier of the structure when required.

One aspect of the present invention provides in a precast concrete structure, a joint connecting together a pair of beams each supported by at least one upright column wherein the joint is disposed substantially at the point of contraflexure of the beams and wherein said joint is a scarf joint having two mating inclined surfaces in abutment one inclined surface being provided by each of the beams.

According to a feature of this aspect of the invention the joint may further include two mating upright surfaces in abutment at one end of the joint, one upright surface being provided by each of the beams. In constructions where this feature is present said beams may be connected together without tensioning by fastening means adjacent an end of said joint remote from said mating upright surfaces.

Preferably, the fastening means comprises a pair of flanges, one carried by each of the respective beams and fasteners by which the flanges are connected together. It is also preferred to locate the fastening means such that they are recessed below the adjacent external faces of the beams said recess thereafter being infilled in situ.

According to another feature of this aspect of the invention the joint may be formed adjacent each of said upright columns of said structure, each of said beams having connecting means for connection to said upright column intermediate the ends of that beam.

According to yet another feature of this aspect of the invention, the structure is multi-tier and the joints between beams in one tier of the structure may be offset out of registry with the joints between beams in the next adjacent tier of the structure.

Another aspect of the invention provides a precast concrete beam for a multi-tier precast concrete structure in which at least one end of the beam is adapted to be secured in abutment with a mating end of another beam said one end including an inclined end face and fastening means by which the beam is interconnected with said other beam.

According to a feature of this aspect of the invention, both ends of the beam may be adapted to be secured in abutment with a mating end of another beam and both said ends include said inclined end face and said fastening means. The inclined end face of the beam extends beyond said fastening means in some beam constructions and other beam constructions are such that the inclined end face of the beam at one of its ends extends beyond said fastening means whereas the inclined end face of the beam at its opposite end is undercut away from said fastening means.

According to yet another feature of this aspect of the invention said beam may be formed with through bores intermediate its ends each to receive connecting rods of said upright column. Preferably, said beam includes an upper central ridge on which a lower face of an upper column section can be received in stepped portions on either side of said central ridge, said through bores being formed in said stepped portions so that fastening means can be applied between said beam and said upper column section. Yet another aspect of the invention provides a method of forming a multi-tier precast concrete structure comprising interconnected upright columns and horizontal beams wherein connected beams in a span are joined together by forming the joint substantially at the point of contraflexure of said span and wherein said beam is connected to an upright column intermediate its ends by being seated on the head of a lower column section by passing connecting means through said beam, seating an upper column section on an upper surface of said beam and marrying together said connecting means of the lower column section to fastening means carried by the upper column section.

According to a feature of this aspect of the invention the connecting means of the lower column section may be married to the connecting means of the upper column section by adjustable fasteners.

An embodiment of the invention will now be described by way of example, with reference to the accompanying drawings, in which:

FIG. 4 is a side elevation of a beam joint and column mounting in a precast concrete structure according to the invention between a pair of horizontal beams and an upright column;

FIG. 5 is a sectional view taken long the line 5—5 in FIG. 4; and

FIG. 6 is a plan view of the construction shown in FIG. 4.

Figure 1:
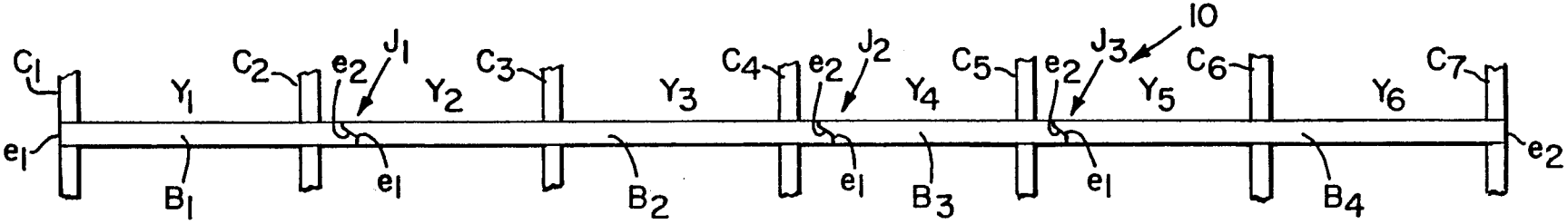
FIG. 1 shows schematically a single tier precast concrete structure according to the invention comprising six bays.

Referring first to FIG. 1 of the drawings a six-bay precast concrete building frame 10 is shown which comprises seven upright colums C1–C7 spanned by a total of four beams B1–B4. The vertical centrelines of the columns are 6 m apart. Precast concrete beam B1 within bay Y1 has one of its ends e1 secured between upper and lower sections of column C1. The opposite end e2 of beam B1 extends beyond column C2 a distance of 1.10 m into bay Y2 from the centreline of column C2 where it is joined to one end e1 of the next succeeding beam B2. The means by which each beam is secured to the columns and the joints by which one beam is secured to another is described hereinafter.

Beam B2 is secured between upper and lower sections of column C2 adjacent end e2 of the beam. Thus, the joint J1 between beams B1 and B2 is disposed in bay Y2 at the point of contraflexure of the span incorporating beams B1 and B2. Beam B2 is supported intermediate its ends at a first location between upper and lower sections of column C3 and at a second location adjacent end e2 between upper and lower sections of column C4. End e2 of beam B2 extends beyond column C4 a distance of 1.1 m into bay Y4 as measured from the vertical centreline of column C4 where it is joined to one end e1 of beam B3. Thus a second joint J2 between beams B2 and B3 is disposed in bay Y4 at the point of contraflexure of the span incorporating beams B2 and B3.

Beam B3 is secured between upper and lower sections of column C5 adjacent end e2 of beam B3. End e2 of beam B3 extends 1.1 m into bay Y5 as measured from the centreline of column C5 where it is joined to end e1 of beam B4. Thus, a third joint J3 between beams B3 and B4 is disposed in bay Y5 at the point of contraflexure of the span incorporating beams B2 and B3. Beam B4 is supported intermediate its ends between upper and lower sections of column C6 and at its opposite end e2 between upper and lower sections of column C7.

Figure 2:
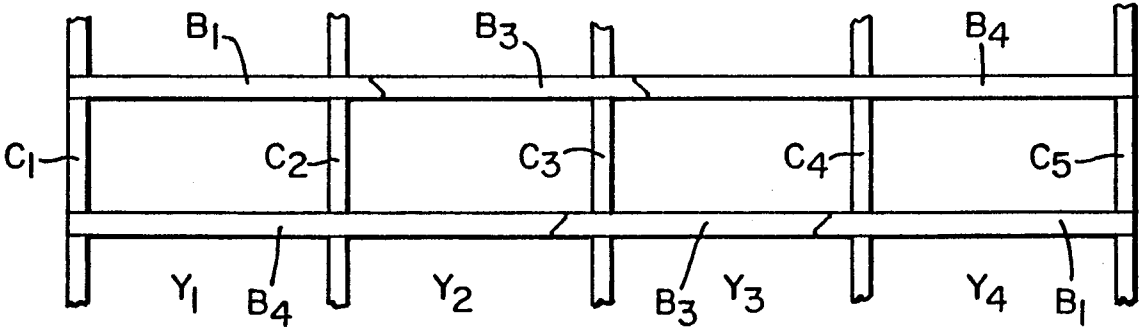
FIG. 2 shows schematically a double tier precast concrete structure according to the invention comprising four bays in each tier.

Beams B1 and B4 therefore have one end comprising a joint face and an opposite end adapted to be secured to an upright column in which beam B1 spans substantially one bay whereas beam B4 spans substantially two bays. Beams B2 and B3 however have both ends comprising a joint face and are adapted to be secured to an upright column at at least one location intermediate their ends. Beam B2 spans substantially two bays whereas beam B3 spans substantially one bay. FIG. 2 shows a four bay frame construction comprising a lower series of beams of types B4, B3 and B1 from left to right providing the support elements for a lower floor of the structure and an upper series of beams of types B1, B3 and B4 providing the support elements for a second floor of the structure. Thus the joint between beams in one level of the structure are offset out of registry with the joints in the beams in the next adjacent level of the structure. By arranging the beams in consecutive floors in this manner staggering of the joints on alternate floors can be achieved.

Figure 3:
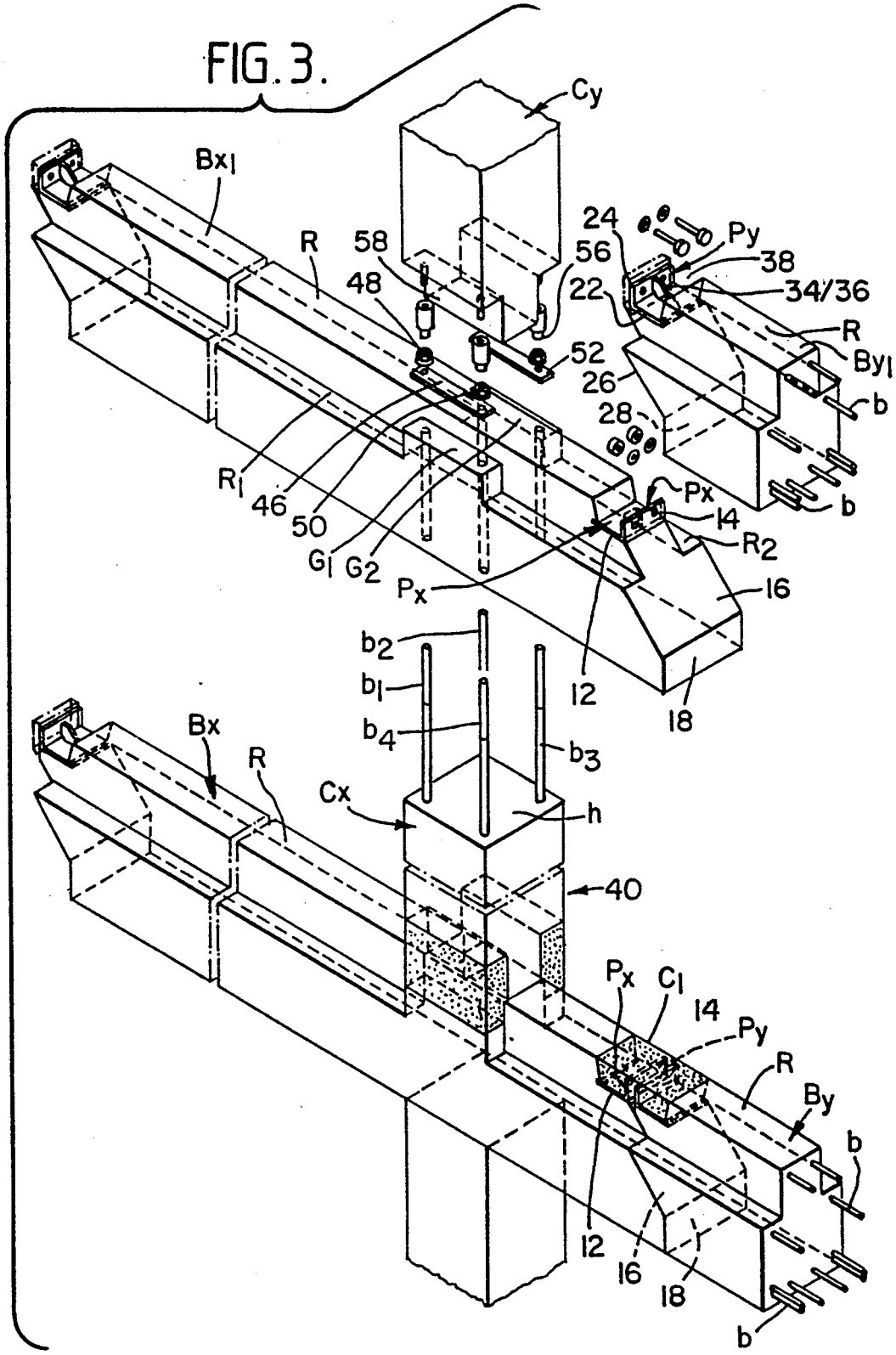
FIG. 3 is a perspective view of two pairs of precast concrete beams having a joint joining together the respective beam ends and in which a lower pair of beams are shown joined together and seated on a column and an upper pair of beams are shown in a position immediately prior to being joined together and mounted on the column.

FIGS. 3 and 4 show a scarf joint 'Js' between two reinforced concrete beams Bx and By joined to each other end to end. In FIG. 3, beams Bx and By are shown joined in a lower tier of a multi-tier structure whereas like beams Bx1 and By1 are shown in an upper tier in position to be joined together. Like reference numerals denote like components in each of the tiers. Both beams Bx and By are pre-cast concrete members incorporating a matrix of internal steel reinforcing bars 'b' as is well known. The beams are of generally inverted "T"-shaped cross-section and thereby have a central elongate upstanding ridge R and stepped portions flanking the ridge which provide shoulders R1 and R2 respectively. The end face of beam Bx includes an upper 'L'-shaped flange plate Px cast into a step 12 formed in the end face of ridge R and is so positioned as to present an upstanding vertical face 14 adjacent the beam end. The end face further includes a downwardly and outwardly sloping surface 16 and a contiguous upright lower surface 18. The angle of the incline of face 16 is typically 45 degrees and thus the inclined face extends beyond the flange plate Px. The end face of beam By is formed to mate with the end face of beam Bx and also includes an upper 'L'-shaped flange plate Py cast into a step 22 in ridge R so as to present upstanding vertical face 24 at the beam end. The end face of beam By further includes a downwardly and inwardly sloping surface 26, i.e. an 'undercut' face, and a contiguous upright lower surface 28.

In order to form a scarf joint according to the invention the mating end faces of beam Bx and By are brought into abutment as shown so that inclined surfaces 16 and 26 and upright lower surfaces 18 and 28 are in mutual contact whereby the upstanding faces 14 and 24 of the flange plates Px and Py are juxtaposed as shown. Bolts 30 are passed through bolt holes formed in faces 14, 24 of the flange plates to fasten them together although such fastenings are not required for ensuring the integrity of the joint. Stiffening plates 34, 36 are then welded to the bolted connections within the recess 38 created at the top of the beam by bringing together the stepped areas 12 and 22. The recess is then filled in situ with a fine concrete infill 'Ci' to surround the bolted connection as shown in stippling in FIG. 3. As was previously mentioned the joint is formed at a distance of 1.10 m from an upright column assembly C of a structure on which the beam is supported, as measured from the centreline of the column to the lower end face (18 or 28) of the joint, so as to be at the point of contraflexure of the span. In this manner the joint is maintained in tension at its upper end and in compression at its lower end. Tests have shown that the positive and negative bending moments and the shear forces are substantially cancelled out at the joint. Thus, substantially no load is transferred through the inclined faces of the joint itself and therefore the joint is not required to have any natural strength as is achieved for example by tensioned reinforcement passing through a beam end joint.

Beam Bx is adapted for connection to a column assembly C of a building structure adjacent the joint face of the beam and this connection 40 will now be described with reference to FIGS. 3 to 6. Lower column section Cx includes four reinforcement bars b1–b4 extending through the column adjacent each of its corners which are interconnected by continuous reinforcing links. Bars b1–b4 project beyond the head 'h' of the column section and terminate in screw-threaded ends. Beam Bx1 is formed with four through bores spaced apart so that the screw-threaded rods can pass through the through bores when the beam is seated on the column section Cx. Before the beam is seated on column section Cx the column head h is first treated to provide a mortar bed on which the beam can seat.

The screw threaded ends of bars b1, b2, b3 and b4 extend through ribs G1 and G2 formed on the opposite shoulder areas R1 and R2 on either side of the central elongate ridge R. Bars b1 and b4 are interconnected by an anchor plate 46 which is secured in place on the short rib G1 by adjustable fastening assemblies 48, 50 and, likewise bars b2 and b3 are interconnected by anchor plate 52 which is secured in place on rib G2 by adjustable fastening assemblies 54, 56.

The base end of upper column section Cy incorporates a downwardly extending projection 58 which is seated in position on the central ridge R of beam Bx1. On either side of projection 58 the base end of column section Cy has corresponding recessed areas A1 and A2 (FIG. 5) in which the adjustable fastening assemblies are accommodated when the upper column section is seated on beam BX1 and the upper and lower column sections then connected together. Once these connections have been made and any necessary adjustments carried out as between beam and column section the recessed areas A1 and A2 as shown in stippling between the low tier upper and lower column sections associated with beams Bx and By are infilled in situ with a cement/sand mortar to make good the joint.

I claim:

1. A multi-tier precast concrete structure comprising upright columns supporting interconnecting beams wherein connected beams in a span are joined together by forming the joint adjacent each of said upright columns substantially at the point of contraflexure of the beams when the beams are under static loading, said joint being a scarf joint having two mating inclined end faces in abutment, one inclined end face being provided by each of said beams having their said mating end faces, said beams connected together, without tensioning, by fastening means adjacent an end of said joint and passing across said joint and wherein each of said beams is connected between the head of a lower column section and the base end of an upper column section, said upper and lower column sections being connected together by fastening means passing through said beam intermediate its ends and remote from said mating end face, wherein said joint further includes two mating upright surfaces in abutment at one end of the joint, one upright surface being provided by each of said beams, wherein said fastening means is remote from said mating upright surfaces and wherein said fastening means comprises a pair of flanges, one carried by each of said respective beams and fasteners by which said flanges are connected together.

2. A multi-tier precast concrete structure comprising upright columns supporting interconnecting beams wherein connected beams in a span are joined together by forming the joint adjacent each of said upright columns substantially at the point of contraflexure of the beams when the beams are under static loading, said joint being a scarf joint having two mating inclined end faces in abutment, one inclined end face being provided by each of said beams having their said mating end faces, said beams connected together, without tensioning, by fastening means adjacent an end of said joint and passing across said joint and wherein each of said beams is connected between the head of a lower column section and the base end of an upper column section, said upper and lower column sections being connected together by fastening means passing through said beam intermediate its ends and remote from said mating end face, wherein said joint further includes two mating upright surfaces in abutment at one end of the joint, one upright surface being provided by each of said beams, wherein said fastening means is remote from said mating upright surfaces and wherein said fastening means comprises a pair of flanges, one carried by each of said respective beams and fasteners by which said flanges are connected together and wherein said fastening means is recessed below the adjacent external faces of said beams said recess thereafter being infilled in situ.

3. A multi-tier precast concrete structure, comprising upright columns supporting interconnecting beams wherein connected beams in a span are joined together by forming the joint adjacent each of said upright columns substantially at the point of contraflexure of the beams when said beams are under static loading, said joint being a scarf joint having two mating inclined end faces in abutment, one inclined end face being provided by each of the beams having their said mating end faces, said beams connected together, without tensioning, by fastening means adjacent an end of said joint and passing across said joint and wherein each of said beams is connected between the head of a lower column section and the base end of an upper column section said upper and lower column sections being connected together by fastening means passing through said beam intermediate its ends and remote from said mating end face, wherein at least one end of the beam is adapted to be secured in abutment with a mating end of another beam, said one end including an inclined end face and fastening means adjacent one end of said inclined end face, said fastening means comprising a flange adapted for connection to a like flange, said flange being recessed below the adjacent external face of the beam and wherein said beam has means intermediate its end to facilitate connection of the beam to an upright column of a multi-tier precast concrete structure.

4. A precast concrete multi-tier structure according to claim 3, wherein said one end of said beam further includes an upright surface contiguous with said inclined surface and remote from said fastening means.

5. A multi-tier precast concrete beam according to claim 3, wherein said inclined end face of the beam extends beyond said fastening means.

6. A multi-tier precast concrete beam according to claim 3, wherein said inclined end face of the beam at one of its ends extends beyond said fastening means whereas an inclined end face of the beam at its opposite end is undercut away from said fastening means.

7. A multi-tier precast concrete beam according to claim 3, wherein said beam is of generally inverted "T"-shaped cross-section having a central elongate upstanding ridge providing said adjacent external face of the beam.

* * * * *